US009243819B2

(12) United States Patent
Funder-Kristensen et al.

(10) Patent No.: US 9,243,819 B2
(45) Date of Patent: Jan. 26, 2016

(54) METHOD FOR OPERATING A VAPOUR COMPRESSION SYSTEM

(75) Inventors: Torben Funder-Kristensen, Soenderborg (DK); Jurgen Suss, Soenderborg (DK); Leo Bram, Augustenborg (DK); Thomas Tiedemann, Offenbach (DE); Toke Rumohr Christiansen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 170 days.

(21) Appl. No.: 13/643,640

(22) PCT Filed: Apr. 26, 2011

(86) PCT No.: PCT/DK2011/000036

§ 371 (c)(1), (2), (4) Date: Nov. 8, 2012

(87) PCT Pub. No.: WO2011/134467

PCT Pub. Date: Nov. 3, 2011

(65) Prior Publication Data

US 2013/0055740 A1 Mar. 7, 2013

(30) Foreign Application Priority Data

Apr. 27, 2010 (DK) ..... 2010 00378

(51) Int. Cl.
*F25B 9/02* (2006.01)
*F25B 5/02* (2006.01)

(52) U.S. Cl.
CPC ..... *F25B 5/02* (2013.01); *F25B 2600/2511* (2013.01)

(58) Field of Classification Search
CPC ..... F25B 5/02; F25B 2600/2511; F25B 2500/01; F25B 39/028
USPC ..... 62/115, 222, 504, 525, 527, 528; 137/624.14, 624.15, 625.11
See application file for complete search history.

(56) References Cited

U.S. PATENT DOCUMENTS 8,191,384 B2 * 6/2012 Funder-Kristensen et al. . 62/504
2009/0217687 A1 * 9/2009 Funder-Kristensen et al. . 62/222

FOREIGN PATENT DOCUMENTS

CN 1467459 A 1/2004
CN 1502898 A 6/2004

(Continued)

OTHER PUBLICATIONS

PCT Search Report for PCT Serial No. PCT/DK2011/000036 dated Nov. 17, 2011.

*Primary Examiner* — Mohammad M Ali
(74) *Attorney, Agent, or Firm* — McCormick, Paulding & Huber LLP

(57) ABSTRACT

A method for operating a vapor compression system is disclosed. The vapor compression system comprises a compressor, a condenser, at least one expansion device, an evaporator, said evaporator comprising at least two evaporator paths arranged fluidly in parallel, and a distribution device arranged to distribute refrigerant among the evaporator paths. The method comprises the steps of obtaining at least two predefined distribution keys, each distribution key defining a distribution of available refrigerant among the evaporator paths, detecting one or more operational settings of the vapor compression system, selecting one of the at least two predefined distribution keys, based on said detected operational setting(s), and distributing refrigerant among the evaporator paths in accordance with the selected predefined distribution key.

11 Claims, 3 Drawing Sheets

(56) References Cited

FOREIGN PATENT DOCUMENTS

| | | | |
|---|---|---|---|
| CN | 101680696 | A | 3/2010 |
| EP | 1 422 483 | A2 | 5/2004 |
| EP | 2 075 516 | A2 | 12/2008 |
| GB | 2 390 419 | A | 1/2004 |
| JP | 2001 272114 | A | 10/2001 |
| JP | 2005 134091 | A | 5/2005 |
| WO | 2008/151629 | A1 | 12/2008 |
| WO | 2008151630 | A1 | 12/2008 |

* cited by examiner

METHOD FOR OPERATING A VAPOUR COMPRESSION SYSTEM

CROSS REFERENCE TO RELATED APPLICATIONS

This application is entitled to the benefit of and incorporates by reference essential subject matter disclosed in International Patent Application No. PCT/DK2011/000036 filed on Apr. 26, 2011 and Danish Patent Application No. PA 2010 00378 filed Apr. 27, 2010.

FIELD OF THE INVENTION

The present invention relates to a method for operating a vapour compression system, such as a heat pump, a refrigeration system or an air condition system, the vapour compression system comprising an evaporator having at least two evaporator paths arranged fluidly in parallel. More particularly, the present invention relates to a method in which refrigerant is distributed among the parallel evaporator paths in accordance with a distribution key which has been selected from at least two predefined distribution keys.

BACKGROUND OF THE INVENTION

Vapour compression systems normally comprise a compressor, a heat rejecting heat exchanger, such as a condenser or a gas cooler, an expansion device and an evaporator arranged in a refrigerant path. A flow of refrigerant circulates the system and is alternatingly compressed and expanded, thereby providing either refrigeration or heating of a volume. Thus, substantially gaseous refrigerant is compressed in the compressor. The compressed refrigerant is supplied to the condenser/gas cooler. In the case of a condenser, the refrigerant condenses, i.e. refrigerant leaving the condenser is in a substantially liquid form. The condensed refrigerant is then expanded in the expansion device before entering the evaporator, where it evaporates. The refrigerant leaving the evaporator is supplied to the compressor, and the cycle is repeated. The supply of refrigerant to the evaporator is often controlled on the basis of a measured superheat value of the refrigerant leaving the evaporator, and in order to obtain a small, but positive, superheat. Thereby it is obtained that the refrigeration capacity of the evaporator is utilised to the greatest possible extent, without risking that liquid refrigerant passes through the evaporator.

In some vapour compression systems the evaporator comprises two or more evaporator paths arranged fluidly in parallel along the refrigerant path. This is, e.g., the case if the vapour compression system comprises two or more evaporators arranged fluidly in parallel, or if the evaporator comprises two or more evaporator tubes arranged fluidly in parallel within the evaporator. In this case the available refrigerant must be distributed among the evaporator paths. It is desirable to perform this distribution in a manner which ensures that the entire refrigeration capacity of the evaporator or evaporators is utilised to the greatest possible extent, while avoiding that liquid refrigerant leaves the evaporator(s).

One way of controlling the operation of a vapour compression system comprising at least two evaporator paths is disclosed in WO 2008/151630 A1. In the method disclosed in WO 2008/151630 A1 the available refrigerant is distributed among two or more evaporators in accordance with an obtained distribution key. The amount of available refrigerant is controlled in response to a superheat value of refrigerant leaving the evaporators, the value being measured at a common outlet of the evaporators, and in order to obtain an optimum superheat value. The distribution key may be generated in such a manner that due consideration is taken to special operating conditions of each of the evaporators in order to obtain optimal filling for all of the evaporators. It may be possible to adjust the distribution key during operation, or the distribution key may be fixed initially.

One drawback of the method disclosed in WO 2008/151630 A1 is that it is not always possible to reach an optimal distribution key within a reasonable time. This is in particular a disadvantage in the case that the operating conditions of the vapour compression system are subject to changes which are substantial and/or rapid. In this case the vapour compression system may be operated in a manner which does not allow for optimal utilisation of the potential refrigeration capacity of the evaporator for a substantial part of the operating time.

SUMMARY OF THE INVENTION

It is, thus, an object of embodiments of the invention to provide a method for operating a vapour compression system comprising an evaporator having at least two evaporator paths, wherein an optimal or nearly optimal distribution of refrigerant among the evaporator paths can be obtained faster than in prior art systems in response to changes in the operating conditions of the vapour compression system.

It is a further object of embodiments of the invention to provide a method for operating a vapour compression system comprising an evaporator having at least two evaporator paths, wherein the method allows the potential refrigeration capacity of the evaporator to be utilised to the greatest possible extent for most of the operating time.

According to the invention there is provided a method for operating a vapour compression system, the vapour compression system comprising a compressor, a heat rejecting heat exchanger, at least one expansion device, an evaporator, said evaporator comprising at least two evaporator paths arranged fluidly in parallel, and a distribution device arranged to distribute refrigerant among the evaporator paths, the method comprising the steps of:

- obtaining at least two predefined distribution keys, each distribution key defining a distribution of available refrigerant among the evaporator paths,
- detecting one or more operational settings of the vapour compression system,
- selecting one of the at least two predefined distribution keys, based on said detected operational setting(s), and
- distributing refrigerant among the evaporator paths in accordance with the selected predefined distribution key.

In the present context the term 'vapour compression system' should be interpreted to mean any system in which a flow of refrigerant circulates and is alternatingly compressed and expanded, thereby providing either refrigeration or heating of a volume. Thus, the vapour compression system may be a refrigeration system, an air condition system, a heat pump, etc. It should be noted that the term 'vapour compression system' should further be interpreted to cover a system which is switchable between a first mode in which it operates as a refrigeration system or an air condition system, and a second mode in which it operates as a heat pump. This will be described in further detail below.

The compressor may be a single compressor, e.g. in the form of fixed speed compressor or in the form of a variable speed compressor. As an alternative, it may be two or more compressors, e.g. forming a compressor rack.

The heat rejecting heat exchanger may be a condenser. As an alternative, in the case that the refrigerant used in which the heat rejection takes place above the critical point, the heat rejecting heat exchanger may be a gas cooler. This is, e.g., the case if $CO_2$ is used as the refrigerant.

The expansion device(s) may be in the form of one or more expansion valves, e.g. thermostatic expansion valves. As an alternative, it may be or comprise one or more orifices or one or more capillary tubes. In any event, the expansion device(s) ensure(s) that refrigerant in a mixed gaseous/liquid phase is supplied to the evaporator.

The evaporator comprises at least two evaporator paths arranged fluidly in parallel. The evaporator paths may be in the form of two or more separate evaporators arranged in parallel along the refrigerant path. As an alternative, the evaporator may be a single evaporator comprising two or more evaporator tubes arranged fluidly in parallel in the evaporator. As another alternative, the evaporator may comprise two or more separate evaporators, at least some of the evaporators comprising two or more evaporator tubes. Furthermore, some or all of the evaporator paths may be grouped, the groups of evaporator paths being arranged fluidly in parallel. One or more of the evaporator paths may be in the form of microchannels.

In the present context the term 'fluidly in parallel' should be interpreted to mean that refrigerant received at an inlet end of the evaporator is split into a number of flow path corresponding to the number of evaporator paths. The refrigerant passes the evaporator via the evaporator paths while being split, and the refrigerant from each of the evaporator paths is collected to form a single flow of refrigerant at an outlet end of the evaporator.

The evaporator and the heat rejecting heat exchanger are both heat exchangers. The components forming the evaporator and the heat rejecting heat exchanger, respectively, may be substantially identical. In this case it may be possible to reverse the flow direction of the refrigerant flowing in the vapour compression system, thereby transforming the vapour compression system from a refrigeration system to a heat pump, or vice versa. This will be described in further detail below.

According to the method of the invention, at least two predefined distribution keys are initially obtained. In the present context the term 'distribution key' should be interpreted to mean a key or a vector determining the distribution of the available refrigerant among the parallel evaporator paths of the evaporator. Thus, a distribution key prescribes how large a part of the available refrigerant should be supplied to each of the parallel evaporator paths. In the present context the term 'predefined' should be interpreted to mean that the at least two distribution keys have been defined and specified previously. Thus, the at least two predefined distribution keys can be regarded as at least two distinct pre-settings, each defining a distinct distribution of the available refrigerant among the parallel evaporator paths.

The at least two predefined distribution keys are preferably fixed keys, i.e. pre-settings, and the step of obtaining the at least two distribution keys may therefore be performed simply by consulting a look-up table containing the distribution keys.

The method further comprises the step of detecting one or more operational settings of the vapour compression system. The operational settings may, e.g., include compressor capacity, fan speed, refrigeration load and/or mode of operation, e.g. heat pump mode or air condition mode. One or more of the operational settings may be detected by measurement. Alternatively or additionally, one or more of the operational settings may be detected by means of actions performed by the vapour compression system during operation. For instance, in the case that the compressor capacity is altered, e.g. in response to a change in refrigeration load or a change in ambient temperature, the compressor may forward information about the altered capacity to a controller before or simultaneously with altering the capacity. This allows the controller to immediately select the predefined distribution key which is best suited for the altered compressor capacity, and an appropriate distribution of refrigerant among the evaporator paths can thereby quickly be reached.

Furthermore, the method comprises the step of selecting one of the at least two predefined distribution keys, based on the detected operational settings. Thus, once the relevant operational settings have been determined, one of the predefined distribution keys is selected. The selected predefined distribution key is the one which provides the most suitable distribution of the available refrigerant among the parallel evaporator paths under the given circumstances, i.e. in view of the detected operational settings.

Finally, the distribution device ensures that the available refrigerant is distributed among the evaporator paths in a prescribed manner, i.e. in accordance with the selected predefined distribution key. The available refrigerant may be distributed among the parallel evaporator paths by adjusting opening degrees of a number of valve openings, each valve opening being arranged in fluid connection with an evaporator path. As an alternative, a valve arrangement may sequentially supply refrigerant to the evaporator paths, in which case the distribution of refrigerant is obtained by adjusting the lengths of time in which the evaporator paths receive refrigerant.

Thus, according to the method of the invention, it is ensured that the available refrigerant is distributed among the parallel evaporator paths in a manner which is suitable under the given circumstances, and that the distribution can easily and quickly be altered to a more suitable distribution in the case that one or more relevant operational settings change. This is an advantage, because it can thereby be obtained that the vapour compression system is operated in an optimal manner for most of the time, i.e. in a manner which allows the potential refrigeration capacity of the evaporator to be utilised to the greatest possible extent, while avoiding that large amounts of liquid refrigerant leaves the evaporator, thereby minimising the risk of causing damage to the compressor.

According to one embodiment, the method may further comprise the steps of:

adjusting the selected predefined distribution key, thereby obtaining an adjusted distribution key, and distributing refrigerant among the evaporator paths in accordance with the adjusted distribution key.

According to this embodiment, the selected predefined distribution key is used as a suitable starting point, based on the known operational settings. The distribution key is then adjusted or fine tuned in order to obtain a distribution key which is truly optimal in view of the circumstances, including circumstances which are not directly related to or caused by the detected operational settings. However, since the selected predefined distribution key is used as a starting point for this adjustment, it must be expected that only minor adjustments are required, and therefore the optimal distribution key can be obtained much faster than would be the case if a suitable predefined distribution key had not been selected as a starting point. Thus, the vapour compression system can be operated in an optimal, or nearly optimal manner for most of the operating time.

The step of adjusting the predefined distribution key may be performed dynamically and/or adaptively during operation of the vapour compression system. The adjustment may, e.g., be performed in the manner described in WO 2008/151629, i.e. by sequentially altering the mass flow of refrigerant through each of the evaporator paths, while keeping the total mass flow of refrigerant through the evaporator paths substantially constant, monitoring the superheat at the outlet of the evaporator, detecting a control parameter when a significant change in superheat occurs, and adjusting the distribution key on the basis of the detected control parameters for each of the evaporator paths.

As an alternative, the vapour compression system may simply be operated in accordance with the selected predefined distribution key until the operational settings are changed in a manner which prescribes that another predefined distribution key provides a more suitable distribution of refrigerant among the evaporator paths, and that this predefined distribution key should therefore be selected instead of the previous one. In this case the vapour compression system may not be operated in an optimal manner, but merely in a nearly optimal manner. However, this may in some cases be sufficient, and the control of the vapour compression system is much simpler than a control strategy requiring continuous and adaptive adjustments of the distribution key.

The step of obtaining at least two predefined distribution keys may comprise:

a) selecting one or more operational settings,
b) operating the vapour compression system at the selected operational setting(s),
c) monitoring the vapour compression system during operation,
d) determining an optimal distribution key for the selected operational setting(s), based on information obtained during the monitoring step,
e) defining the optimal distribution key as a predefined distribution key for the selected operational setting(s),
f) selecting one or more new operational settings, and
g) repeating steps a)-f) until a desired number of predefined distribution keys has been defined.

According to this embodiment, the at least two predefined distribution keys are preferably defined for a specific vapour compression system before the vapour compression system is set into operation. The steps described above may, e.g., be performed in a laboratory under controlled circumstances, and the predefined distribution keys may be stored in a controller which is to control the vapour compression system during normal operation. The operational settings selected during this procedure are preferably operational settings which are expected to occur during normal operation of the vapour compression system, e.g. with due consideration to ambient conditions and application of the vapour compression system. When the vapour compression system is subsequently installed and starts operating, the controller ensures that a suitable one of the predefined distribution keys is selected under the given circumstances, as described above.

As an alternative, the predefined distribution keys may be defined by the manufacturer based purely on the type of vapour compression system. As another alternative, the predefined distribution keys may be defined in the manner described above each time the vapour compression system is started.

The operational settings may include compressor capacity, refrigeration load, refrigeration capacity, secondary mass flow across the evaporator, and/or mode of operation.

An operational setting being indicative for the compressor capacity may, e.g., be a compressor step or the speed of a variable speed compressor. An operational setting being indicative for the refrigeration load may, e.g., be the capacity of the vapour compression system. An operational setting being indicative for a secondary mass flow across the evaporator may, e.g., be a rotational speed of a fan arranged to blow air across the evaporator. An operational setting being indicative for the mode of operation may, e.g., be information regarding whether the vapour compression system is operated as an air condition system or as a heat pump. This is only relevant for vapour compression systems in which it is possible to switch between these two modes of operation.

The table below illustrates an example of predefined distribution keys which are suitable for various values of the operational settings described above in a vapour compression system comprising four parallel evaporator paths.

| Comp. speed | Capacity % | Fan speed | Distribution vector (OD) | | | |
|---|---|---|---|---|---|---|
| 1 | 10 | low | 1.1 | 1.2 | 0.9 | 0.8 |
| 1 | 20 | low | 1.1 | 1.2 | 0.9 | 0.8 |
| 1 | 30 | low | 1.3 | 1.1 | 0.9 | 0.8 |
| 1 | 40 | low | 1.3 | 1.1 | 0.8 | 0.8 |
| 2 | 50 | high | 1.3 | 1.1 | 0.8 | 0.8 |
| 2 | 60 | high | 1.3 | 1.1 | 0.8 | 1.2 |
| 2 | 80 | high | 1.3 | 1.1 | 0.7 | 1.2 |
| 2 | 100 | high | 1.3 | 1.1 | 0.7 | 1.2 |

In the example illustrated in the table above, a distribution vector in which all of the four parallel evaporator paths have an opening degree (OD) of 1 corresponds to a situation in which the four evaporator paths receive equal amounts of refrigerant. An opening degree which is larger than 1 therefore indicates that the corresponding evaporator path receives more than ¼ of the available refrigerant, and an opening degree which is smaller than 1 indicates that the corresponding evaporator path receives less than ¼ of the available refrigerant. It is clear from the table that, in the illustrated example, the opening degrees of the evaporator paths are not adjusted in a linear manner in response to changes in the operational settings. This underlines that it is an advantage to be able to select a pre-setting for the distribution key in response to changes in the operational settings.

At least one of the predefined distribution keys may define a distribution in which a flow of refrigerant towards at least one of the parallel evaporator paths is prevented. According to this embodiment it is possible to select a distribution key which prescribes that at least one of the evaporator paths should be shut off completely, the available refrigerant being distributed among the remaining evaporator paths. This may be desirable, e.g. in the case that one or more of the evaporator paths need to be defrosted. Several predefined distribution keys may define a distribution where one of the evaporator paths is shut completely off, for instance one distribution key per evaporator path, thereby providing the possibility of shutting off any one of the evaporator paths. These distribution keys may, e.g., be provided in the form of 'masks' or additional keys applied onto the other predefined distribution keys in such a manner that one evaporator path is shut off while the mutual distribution of refrigerant among the remaining evaporator paths is maintained, i.e. is selected in accordance with the detected operational settings.

At least one of the predefined distribution keys may define a defrost mode of the vapour compression system. As described above, such a defrost mode may advantageously be a mode in which the supply of refrigerant towards one or more of the parallel evaporator paths is prevented.

When frost is building up on the evaporator surface, in most cases the heat transfer between refrigerant in the evaporator and a secondary fluid flow across the evaporator, normally in the form of an air flow, is affected negatively by the isolating layer of frost. Furthermore, the area where the air flow passes is reduced, thereby increasing the air side pressure drop. After a certain time the frost layer can become so thick that parts of the evaporator are blocked completely, thereby preventing the passage of a secondary air flow across the evaporator. Reduced heat transferring capability and increased air side pressure drop of the evaporator reduce the system capacity and efficiency considerably. It is therefore necessary to defrost the evaporator paths when a layer of frost starts forming on them, in order to maintain proper functionality of the system.

When conditions are such that frost accumulates on the surfaces of the evaporator paths, preventing a supply of refrigerant to an evaporator path prevents further frost build up on this evaporator path. If the frost layer is sufficiently thin, air will continue to flow across the evaporator path while the flow of refrigerant towards the evaporator path is prevented. In the case that the air temperature is above 0° C., the frost will melt and be removed from the surface of the evaporator path by the secondary air flow. Accordingly, sequentially preventing a flow of refrigerant towards each of the evaporator paths for a short period of time may be sufficient to prevent that a thick frost layer builds up on the surface of one or more of the evaporator paths, and thereby defrost of the evaporator is obtained in a very easy manner and substantially without affecting the operation of the vapour compression system. This is sometimes referred to as 'silent defrost'.

Alternatively or additionally, one or more of the predefined distribution keys may define a standard defrost mode. It may, e.g., be necessary to select such a standard defrost mode in the case that the frost layer on the surface of one of the evaporator paths is too thick to be removed by means of the secondary air flow in the manner described above, and/or in the case that the temperature of the ambient air is too low to provide this.

The method may further comprise the step of obtaining information regarding ambient conditions, and the step of selecting one of the at least two predefined distribution keys may further be based on the obtained information regarding ambient conditions. The ambient conditions may include, but are not limited to, temperature and/or humidity of the ambient air. This embodiment is particularly advantageous in the case that one or more of the predefined distribution keys defines a defrost mode of the vapour compression system, since the temperature as well as the humidity level of the ambient air has significant influence on the formation of frost layer on the evaporator. Furthermore, in the case that the temperature of the ambient air is well below 0° C., the secondary air flow is not capable of removing a frost layer on an evaporator path using the 'silent defrost' approach described above, and a low ambient air temperature therefore indicates that a standard defrost mode should be selected. Thus, the information regarding ambient conditions may therefore be used as additional basis for selecting one of the predefined distribution keys, in particular in the case that the selected predefined distribution key defines a defrost mode for the vapour compression system.

Alternatively or additionally, at least one of the predefined distribution keys may define a safe operating mode of the vapour compression system. The safe operating mode is preferably an operating mode in which it is ensured that no damage can be caused to the vapour compression system or to any of its components. Such a safe operating mode may, e.g., be selected in the case that unexpected low superheat values are measured. One example of a safe operating mode could be a distribution key defining an equal distribution of the available refrigerant among the parallel evaporator paths, with low opening degrees, thereby preventing that the evaporator, and consequently the compressor, is flushed. Another example could be a distribution key defining a distribution of the available refrigerant in which refrigerant is only supplied to one or more, but not all, of the parallel evaporator paths in order to improve oil return to the compressor. Yet another example could be a distribution key defining a distribution of the available refrigerant in which some or all of the parallel evaporator paths are only partially filled with refrigerant in order to obtain a low evaporation temperature for drying purposes.

The distribution device may form part of an expansion device, and the step of distributing refrigerant among the parallel evaporator paths may be performed while expanding the refrigerant. According to this embodiment, a single component provides substantially simultaneous expansion of the refrigerant and distribution of the available refrigerant among the evaporator paths. This may, e.g., be obtained by means of a valve comprising two mutually rotatable disks, one disk being provided with a number of orifices corresponding to the number of evaporator paths, each orifice being fluidly connected to an evaporator path, and the other disk being provided with a single orifice which may be moved to positions corresponding to each of the orifices provided in the first disk. Thus, the mutual rotational position of the two disks defines which of the evaporator paths receives refrigerant. The distribution of refrigerant among the evaporator paths is then determined by the length of time the orifice of the second disk is arranged at positions corresponding to the orifices provided in the first disk.

As an alternative, each of the evaporator paths may be provided with an individually controllable valve, e.g. an expansion valve, in which case the distribution of the available refrigerant among the evaporator paths is determined by the opening degrees of the valves.

The method may further comprise the step of reversing the flow direction of refrigerant flowing in the vapour compression system. According to this embodiment, the vapour compression system may be switchable between a refrigerating or air condition mode and a heat pump mode. The vapour compression system may be arranged in a building in such a manner that one heat exchanger is arranged exterior of the building, i.e. in contact with the outside air, and another heat exchanger is arranged in a room inside the building. When the outside temperature is high, it is desirable to operate the vapour compression system as an air condition system, thereby providing cooling to the room inside the building. When the outside temperature is low, it is desirable to operate the vapour compression system as a heat pump, thereby providing heating to the room inside the building.

If substantially identical components are selected for the two heat exchangers, it is possible to reverse the refrigerant flow in the vapour compression system, thereby allowing the heat exchangers to 'switch roles', i.e. the evaporator becomes the heat rejecting heat exchanger and the heat rejecting heat exchanger becomes the evaporator. Thus, in the air condition mode, the heat exchanger arranged inside the room is the evaporator and the heat exchanger arranged exterior of the building is the heat rejecting heat exchanger. In the heat pump mode, the refrigerant flow is reversed, and the heat exchanger inside the room is the heat rejecting heat exchanger while the heat exchanger arranged exterior of the building is the evaporator.

BRIEF DESCRIPTION OF THE DRAWINGS

The invention will now be described in further detail with reference to the accompanying drawings in which.

DETAILED DESCRIPTION

Figure 1:
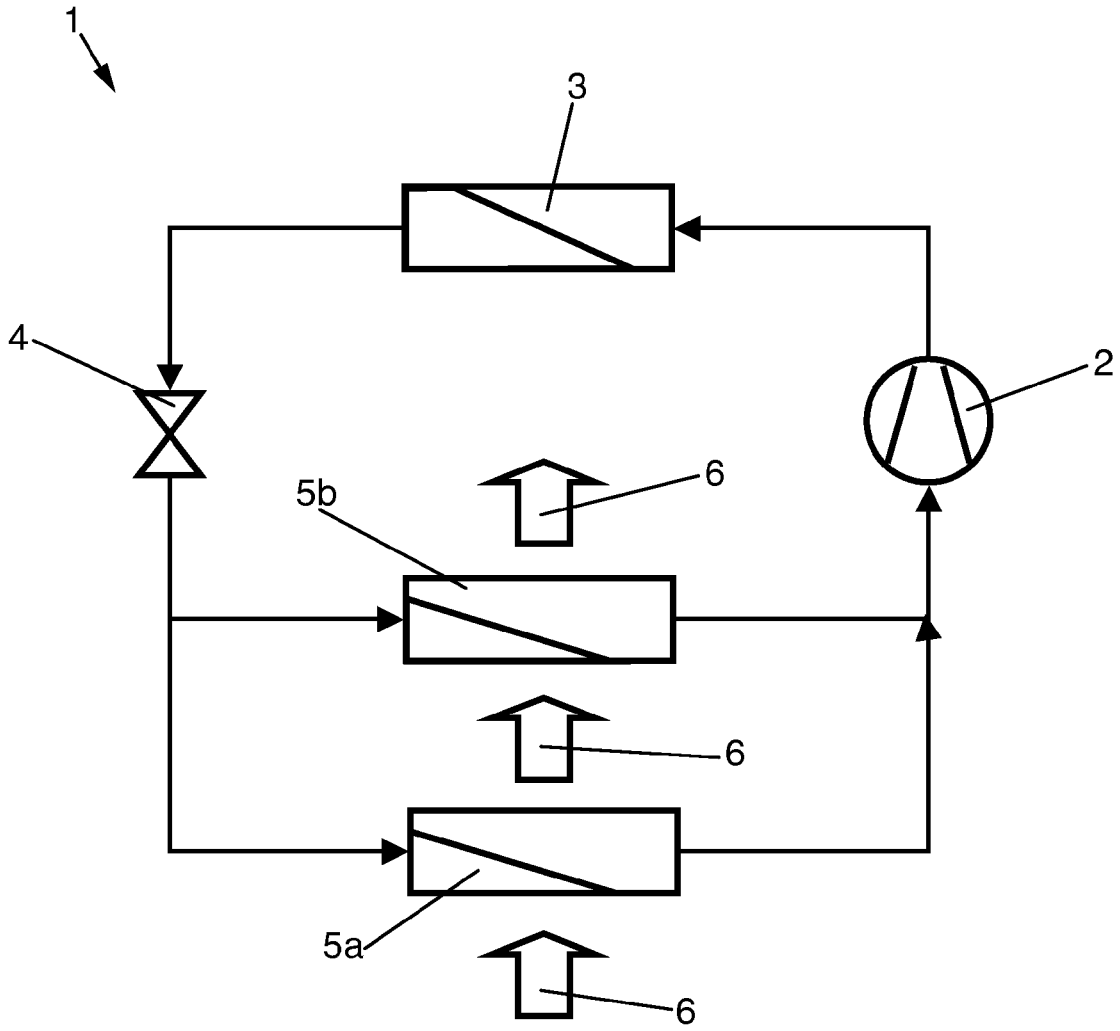
FIG. 1 is a schematic diagram illustrating a vapour compression system.

FIG. 1 is a schematic diagram illustrating a vapour compression system 1, comprising a compressor 2, a condenser 3, an expansion device 4 and an evaporator 5 arranged along a refrigerant path. It should be noted that the condenser 3 could be replaced by a gas cooler in the case that the vapour compression system 1 is adapted to run transcritically. The evaporator 5 comprises a first evaporator path 5*a* and a second evaporator path 5*b*. The evaporator paths 5*a*, 5*b* are arranged fluidly in parallel along the refrigerant path between the expansion device 4 and the compressor 2. Thereby, refrigerant delivered by the expansion device 4 is split into two parallel refrigerant flows, one passing through the first evaporator path 5*a* and the other passing through the second evaporator path 5*b*. The refrigerant flowing through the first evaporator path 5*a* and the refrigerant flowing through the second evaporator path 5*b* are collected to form a single refrigerant flow before entering the compressor 2. The evaporator paths 5*a*, 5*b* are arranged in series with respect to a secondary air flow, illustrated by arrows 6, across the evaporator 5.

The vapour compression system 1 of FIG. 1 may advantageously be operated in the following manner. Refrigerant is compressed in the compressor 2. The compressed refrigerant is supplied to the condenser 3, where it is condensed, the refrigerant leaving the condenser 3 thereby being in a substantially liquid form. The liquid refrigerant is supplied to the expansion device 4 where it is expanded and divided into two parallel fluid flows in accordance with a selected distribution key and supplied to the evaporator paths 5*a*, 5*b*. The distribution may be performed by the expansion device 4, or it may be provided by a separate device (not shown), e.g. by means of two separate and individually controllable valves, each valve being connected to one of the evaporator paths 5*a*, 5*b* and controlling the refrigerant flow thereto.

The refrigerant supplied to the evaporator paths 5*a*, 5*b* is in a mixed gaseous/liquid phase. In the evaporator, the refrigerant is evaporated, and heat exchange takes place between the evaporating refrigerant and the air 6 flowing across the evaporator 5, thereby reducing the temperature of the air flow 6. Finally, the two parallel refrigerant flows are collected into a single refrigerant flow and supplied to the compressor 2 where it is compressed, thereby repeating the refrigeration cycle.

Figure 2:
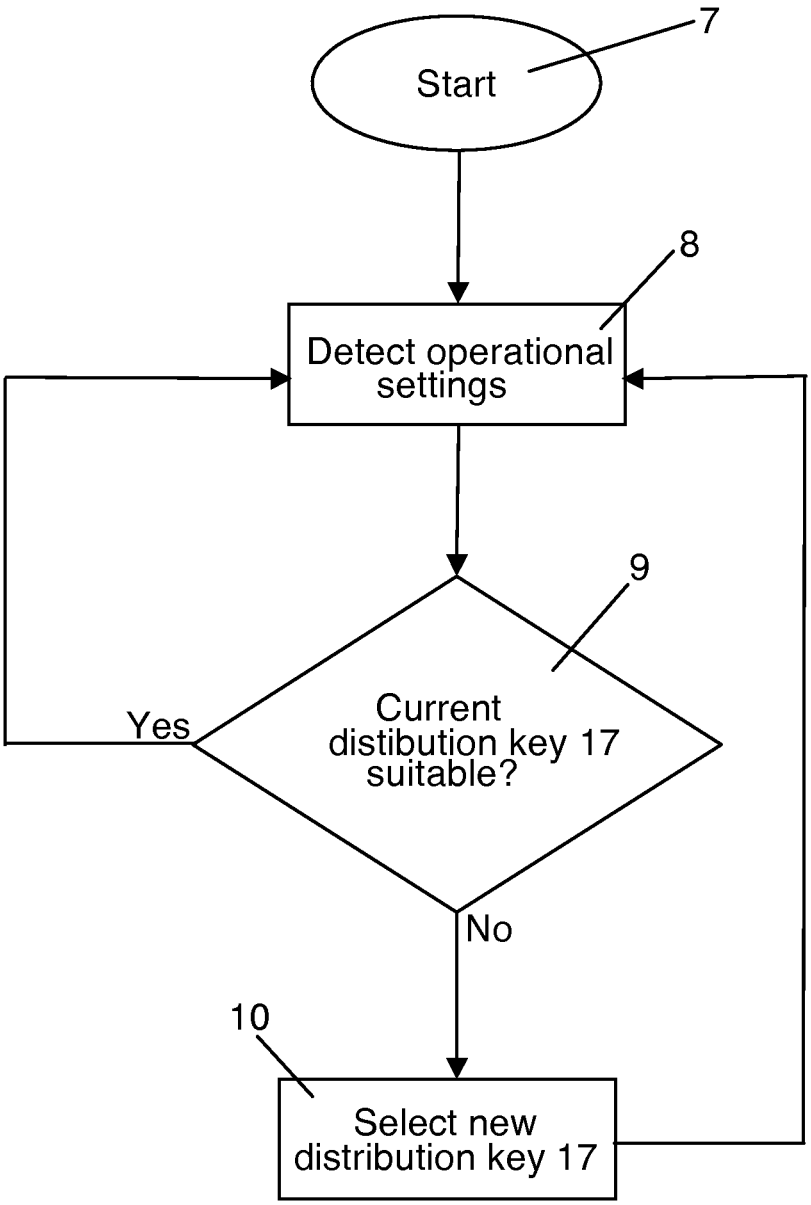
FIG. 2 is a flow chart illustrating method steps of a method according to a first embodiment of the invention.

FIG. 2 is a flow chart illustrating method steps of a method according to a first embodiment of the invention.

The process is started in step 7. In step 8 relevant operational settings, such as compressor capacity, refrigeration load, fan speed and/or mode of operation, are detected. The operational settings may be detected by measuring the operational settings either directly or indirectly. As an alternative, one or more of the operational settings may be supplied to a controller directly from the relevant components of the vapour compression system. This may, e.g., be the case for compressor capacity and/or fan speed. When it is determined that the compressor capacity or the fan speed is to be altered in response to changes in the operating conditions, e.g. changes in one or more control parameter values, the compressor and/or the fan can supply the new setting to the controller either before or simultaneously with the change in compressor capacity or fan speed. This allows the controller to select an appropriate distribution key immediately when the change in operational setting occurs and may be referred to as a 'feed forward' strategy.

In step 9 it is investigated whether or not the currently used distribution key 17 is suitable in view of the detected operational settings. If this is the case, the vapour compression system is continued to be operated in accordance with the current distribution key 17, and the process is returned to step 8, where the operational settings are once again detected, and any changes as compared to the previous detection are noted.

In the case that the investigation of step 9 reveals that the currently used distribution key 17 is not appropriate, a different one of the predefined distribution keys 17 is selected at step 10. The vapour compression system is then operated in accordance with the new selected predefined distribution key 17, and the process is returned to step 8, where the operational settings are once again detected.

Figure 3:
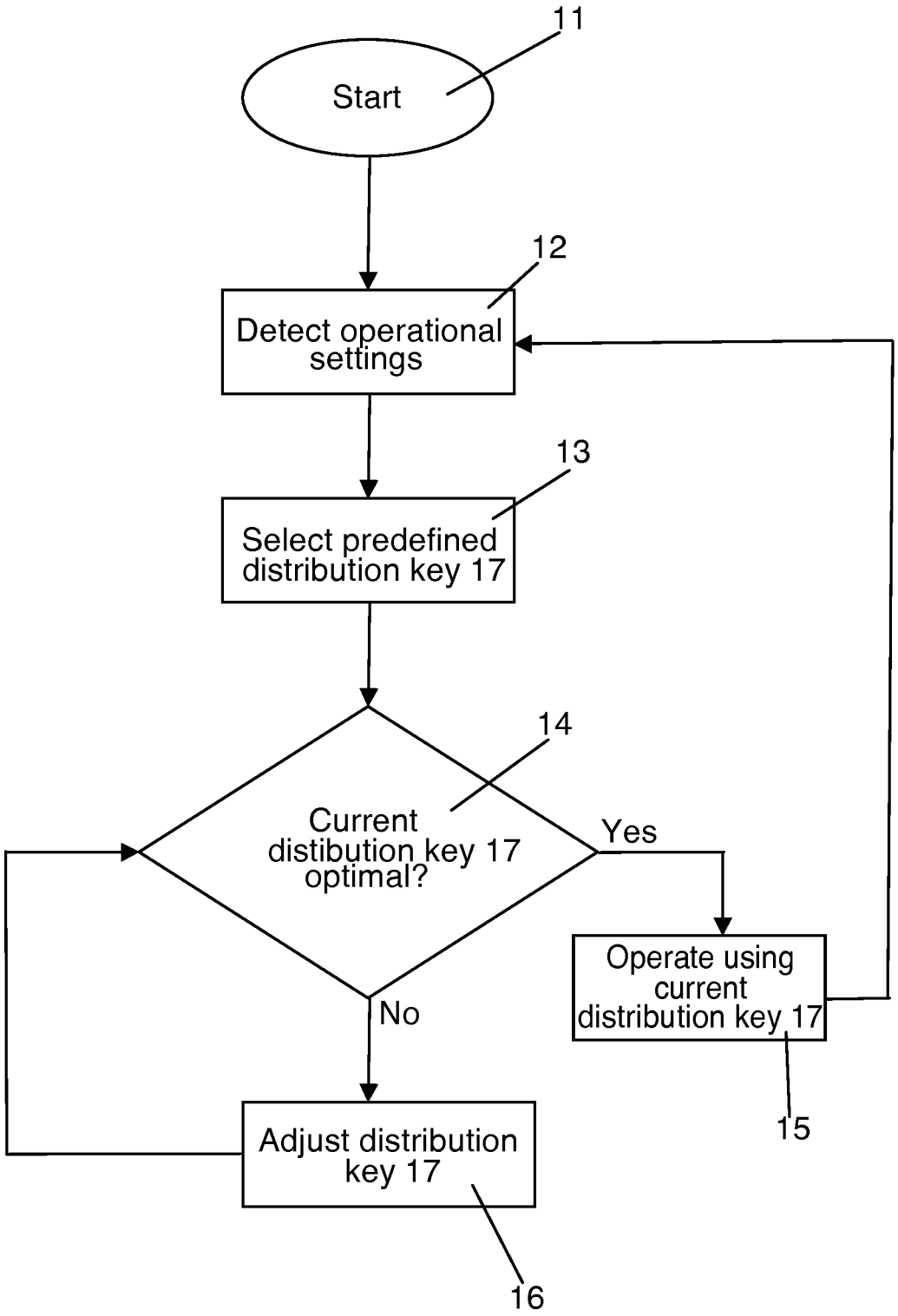
FIG. 3 is a flow chart illustrating method steps of a method according to a second embodiment of the invention.

FIG. 3 is a flow chart illustrating method steps of a method according to a second embodiment of the invention.

The process is started in step 11. In step 12 the operational settings of the vapour compression system are detected in the manner described above with reference to the flow chart of FIG. 2. In step 13 a predefined distribution key 17 is selected, based on the detected operational settings. The selected predefined distribution key 17 is the one among the predefined distribution keys which provides the most optimal distribution of available refrigerant among the parallel evaporator paths, given the detected operational settings.

In step 14 it is investigated whether or not the selected predefined distribution key 17 is optimal, i.e. whether or not the distribution of available refrigerant defined by the selected predefined distribution key 17 is actually the one which provides the best possible utilisation of the potential refrigeration capacity of the evaporator. If this is the case, the selected predefined distribution key 17 is maintained, the vapour compression system is operated in accordance with this distribution key 17, in step 15, and the process is returned to step 12, where the operational settings are once again detected.

If the investigation in step 14 reveals that the selected predefined distribution key 17 does not result in an optimal utilisation of the potential refrigeration capacity of the evaporator, the distribution key 17 is adjusted in step 16. This may, e.g., be done by altering the a mass flow of refrigerant through one of the evaporator paths while keeping the total mass flow of refrigerant through all of the evaporators substantially constant, monitoring the superheat of refrigerant leaving the evaporator, detecting a control parameter when a significant change in superheat is detected, repeating these steps for each of the evaporator paths, and adjusting the distribution key 17 on the basis of the detected control parameters.

The process is then returned to step 14 in order to investigate whether or not the adjusted distribution key 17 is optimal. Thus, in the method illustrated in FIG. 3, a pre-set distribution key 17 is initially selected and used as a starting point for an adaptive adjustment of the distribution key 17, i.e. a fine tuning of the distribution key 17 in order to obtain a truly optimal distribution of the available refrigerant among the evaporator paths. The optimal distribution key 17 is quickly reached because an appropriate predefined distribution key 17 is used as a starting point for the adaptive adjustment.

Although various embodiments of the present invention have been described and shown, the invention is not restricted thereto, but may also be embodied in other ways within the scope of the subject-matter defined in the following claims.

What is claimed is:

1. A method for operating a vapour compression system, the vapour compression system comprising a compressor, a heat rejecting heat exchanger, at least one expansion device, an evaporator, said evaporator comprising at least two evaporator paths arranged fluidly in parallel, and a distribution device arranged to distribute refrigerant among the evaporator paths, the method comprising the steps of:

obtaining at least two predefined distribution keys, each distribution key including a preset vector defining a distribution of available refrigerant among the evaporator paths, with each evaporator path having a distinct portion of the available refrigerant preset in the vector of each predefined distribution key, detecting one or more operational settings of the vapour compression system, selecting one of the at least two predefined distribution keys, based on said detected operational setting(s), and distributing refrigerant among the evaporator paths in accordance with the selected predefined distribution key so that each evaporator path receives the distinct preset portion of the available refrigerant defined in the vector.

2. The method according to claim 1, further comprising the steps of:

adjusting the selected predefined distribution key, thereby obtaining an adjusted distribution key, and distributing refrigerant among the evaporator paths in accordance with the adjusted distribution key.

3. The method according to claim 2, wherein the step of adjusting the predefined distribution key is performed dynamically during operation of the vapour compression system.

4. The method according to claim 1, wherein the step of obtaining at least two predefined distribution keys comprises:

a) selecting one or more operational settings, b) operating the vapour compression system at the selected operational setting(s), c) monitoring the vapour compression system during operation, d) determining an optimal distribution key for the selected operational setting(s), based on information obtained during the monitoring step, e) defining the optimal distribution key as a predefined distribution key for the selected operational setting(s), f) selecting one or more new operational settings, and g) repeating steps a)-f) until a desired number of predefined distribution keys has been defined.

5. The method according to claim 1, wherein the operational settings include compressor capacity, refrigeration load, refrigeration capacity, secondary mass flow across the evaporator, and/or mode of operation.

6. The method according to claim 1, wherein at least one of the predefined distribution keys defines a distribution in which a flow of refrigerant towards at least one of the parallel evaporator paths is prevented.

7. The method according to claim 1, wherein at least one of the predefined distribution keys defines a defrost mode of the vapour compression system.

8. The method according to claim 1, further comprising the step of obtaining information regarding ambient conditions, and wherein the step of selecting one of the at least two predefined distribution keys is further based on the obtained information regarding ambient conditions.

9. The method according to claim 1, wherein at least one of the predefined distribution keys defines a safe operating mode of the vapour compression system.

10. The method according to claim 1, wherein the distribution device forms part of an expansion device, and wherein the step of distributing refrigerant among the parallel evaporator paths is performed while expanding the refrigerant.

11. The method according to claim 1, further comprising the step of reversing the flow direction of refrigerant flowing in the vapour compression system.

* * * * *